US010240853B2

(12) United States Patent
Mercer et al.

(10) Patent No.: US 10,240,853 B2
(45) **Date of Patent: *Mar. 26, 2019**

(54) UPFLOW CONDENSATE DRAIN PAN

(71) Applicant: Carrier Corporation, Farmington, CT (US)

(72) Inventors: Kevin Mercer, Danville, IN (US); Barry W. Lee, Greenwood, IN (US); Ryan K. Dygert, Cicero, NY (US)

(73) Assignee: CARRIER CORPORATION, Farmington, CT (US)

( * ) Notice: Subject to any disclaimer, the term of this patent is extended or adjusted under 35 U.S.C. 154(b) by 221 days.

This patent is subject to a terminal disclaimer.

(21) Appl. No.: 14/493,646

(22) Filed: Sep. 23, 2014

(65) Prior Publication Data

US 2015/0153095 A1 Jun. 4, 2015

Related U.S. Application Data

(60) Provisional application No. 61/910,760, filed on Dec. 2, 2013.

(51) Int. Cl.
*F25D 21/14* (2006.01)
*F24F 13/22* (2006.01)
*F28F 17/00* (2006.01)

(52) U.S. Cl.
CPC ..... *F25D 21/14* (2013.01); *F24F 13/222* (2013.01); *F28F 17/005* (2013.01); *F25D 2321/144* (2013.01)

(58) Field of Classification Search
CPC ..... F25D 21/14; F25D 21/00; F25D 2321/14; F25D 2321/144; F25D 2321/145; F25D 2321/143; F25D 2321/1441; F25D 2321/1442; F24F 13/222
See application file for complete search history.

(56) References Cited

U.S. PATENT DOCUMENTS 2,136,222 A * 11/1938 Starr ..... A47F 3/0417 165/133
2,175,396 A * 10/1939 Hoffman ..... A47F 3/0417 62/255
2,797,560 A * 7/1957 Kooiker ..... F24F 13/224 62/279
3,750,418 A * 8/1973 Maudlin ..... F25B 39/02 165/181
4,410,033 A * 10/1983 Wawro ..... F24F 1/0007 165/137
4,662,594 A * 5/1987 Dubis ..... E06C 7/143 248/231.21
4,907,420 A * 3/1990 Mahanay ..... F25D 21/14 62/285
5,195,332 A * 3/1993 Sullivan ..... F24F 1/0007 62/285

(Continued)

*Primary Examiner* — Hung Q Nguyen
*Assistant Examiner* — Mark L. Greene
(74) *Attorney, Agent, or Firm* — Cantor Colburn LLP

(57) ABSTRACT

A condensate drain pan including a drain pan surface, a front wall, including a front wall longitudinal axis, a rear wall, and opposing side walls. The front wall, the rear wall, and the opposing side walls extend from the drain pan surface. The front wall includes a first aperture and a second aperture. The first aperture and the second aperture include an aperture axis.

8 Claims, 6 Drawing Sheets

(56) References Cited

U.S. PATENT DOCUMENTS 5,263,892 A * 11/1993 Vandervaart ..... F24F 1/0007 165/240
5,511,386 A 4/1996 Russ et al.
5,613,554 A 3/1997 Bull et al.
5,664,431 A 9/1997 Martin, Sr.
5,699,677 A * 12/1997 Hakala ..... C08G 18/10 62/291
5,715,697 A 2/1998 Rust, Jr. et al.
5,904,053 A 5/1999 Polk et al.
5,966,959 A * 10/1999 Stewart ..... F24F 13/222 62/285
5,987,909 A 11/1999 Martin, Sr.
6,112,536 A 9/2000 Hansen
6,276,443 B1 8/2001 Martin, Sr.
6,978,909 B2 12/2005 Goetzinger et al.
7,003,972 B2 2/2006 Eom et al.
7,185,513 B2 3/2007 Bush et al.
7,263,850 B2 9/2007 Eom et al.
7,418,826 B2 9/2008 Rios et al.
7,418,827 B2 9/2008 Rios
7,669,641 B2 3/2010 Rembold et al.
7,793,514 B2 9/2010 Rios et al.
7,854,141 B1 * 12/2010 Breen ..... F24F 1/022 62/272
8,220,282 B2 7/2012 Hast et al.
9,746,232 B2 * 8/2017 Forrest ..... F25D 21/14
2002/0088239 A1 * 7/2002 Goldstein ..... F24F 5/0096 62/173
2010/0041327 A1 * 2/2010 Desler ..... F24F 1/0007 454/184
2011/0232861 A1 9/2011 Stewart et al.
2011/0265508 A1 * 11/2011 Piccione ..... F24F 13/222 62/291
2012/0159981 A1 6/2012 Beck et al.
2015/0153096 A1 * 6/2015 Mercer ..... F24F 13/222 62/291

* cited by examiner

UPFLOW CONDENSATE DRAIN PAN

CROSS REFERENCE TO RELATED APPLICATIONS

The present application is related to, and claims the priority benefit of, U.S. Provisional Patent Application Ser. No. 61/910,760 filed Dec. 2, 2013, the contents of which are hereby incorporated in their entirety into the present disclosure.

TECHNICAL FIELD OF THE DISCLOSED EMBODIMENTS

The presently disclosed embodiments generally relate to appliances for heating and cooling air, and more particularly, to an upflow condensate drain pan.

BACKGROUND OF THE DISCLOSED EMBODIMENTS

In a conventional refrigerant cycle, a compressor compresses a refrigerant and delivers the compressed refrigerant to a downstream condenser. From the condenser, the refrigerant passes through an expansion device, and subsequently, to an indoor. The refrigerant from the indoor is returned to the compressor. In a split system heating and/or cooling system, the condenser may be known as an outdoor heat exchanger and the indoor as an indoor heat exchanger, when the system operates in a cooling mode. In a heating mode, their functions are reversed.

In the split system, the indoor may be part of a fan coil assembly. A typical fan coil assembly includes an indoor coil (e.g., a coil shaped like a "V", which is referred to as a "V-coil") and a condensate drain pan disposed within a casing. A V-coil may be referred to as a "multi-poise" coil because it may be oriented either horizontally or vertically in the casing of the fan coil assembly.

During a cooling mode operation, a blower circulates air through the casing of the fan coil assembly, where the air cools as it passes over the indoor coil. The blower then circulates the air to a space to be cooled. Depending on the particular application, a fan coil assembly including a vertically oriented V-coil may be an upflow arrangement.

Typically, a refrigerant is enclosed in piping that is used to form the indoor coil. If the temperature of the indoor coil surface is lower than the dew point of air passing over it, the indoor coil removes moisture from the air. Specifically, as air passes over the indoor coil, water vapor condenses on the indoor coil. The condensate drain pan of the indoor assembly collects the condensed water as it drips off of the indoor coil, or runs along the surface of the indoor coil. The collected condensation then typically drains out of the condensate drain pan through at least one of two drain holes in the condensate drain pan. Typically, the drain holes are oriented in a substantially vertical orientation to accommodate the primary drainage and an overflow drainage. The substantially vertical orientation increases the overall size of the condensate drain pan; thus, this orientation may increase the size and cost of the fan coil assembly. There is, therefore, a need for a smaller sized condensate drain pan.

SUMMARY OF THE DISCLOSED EMBODIMENTS

In one aspect, a condensate drain pan configured to contain a portion of a coil is provided. In one embodiment, the condensate drain pan includes a front wall, a rear wall, and opposing side walls extending from a drain pan panel, including a panel interior side and a panel exterior side, to form a receptacle. In one embodiment, the front wall includes a front wall longitudinal axis, a first aperture, and a second aperture. The first aperture and the second aperture include an aperture axis that forms an angle less than 90 degrees with the front wall longitudinal axis. In one embodiment, at least a portion of the opposing side walls include a curvature biased towards the drain pan surface. In one embodiment, the curvatures may be adjacent to the drain pan surface. In at least one embodiment a channel member may be formed on the panel exterior side. In at least one embodiment, the channel member may be longitudinally disposed on the panel exterior side. In at least one embodiment, the channel member may be substantially centered on a longitudinal axis on the panel exterior side.

In one aspect, a fan coil assembly is provided. In one embodiment, the fan coil assembly includes a coil, including a first coil slab and a second coil slab, disposed within a casing. The fan coil assembly further includes the condensate drain pan positioned to receive at least a portion of condensate that may drip from the coil. In one embodiment, a first space may be created between an edge of the first coil slab and one of the opposing side walls, and a second space may be created between an edge of the second coil slab and the other opposing side wall. In one embodiment, the first space and the second space include a first dimension less than or equal to approximately 0.375 inch.

In one embodiment, a third space may be created between an end of the first coil slab and a top edge of one of the opposing side walls, and a fourth space may be created between an end of the second coil slab and a top edge of the other opposing wall. In one embodiment, the third space and the fourth space include a second dimension less than or equal to approximately 0.750 inch.

In one embodiment, the fan coil assembly further includes a fan disposed within the casing. In one embodiment, the fan coil assembly further includes an auxiliary heating assembly operably coupled to the casing.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
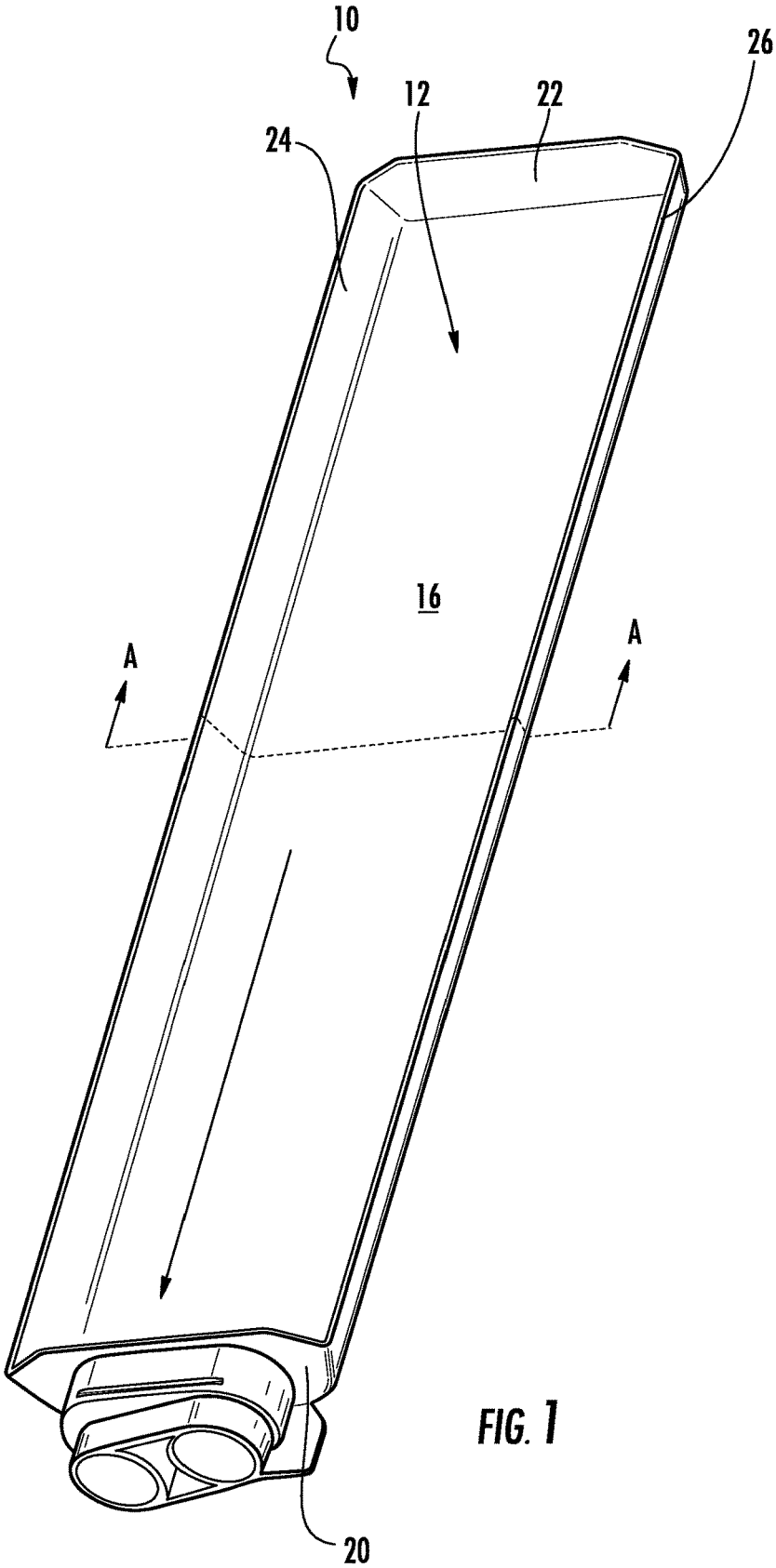
FIG. 1 is a perspective view of an upflow condensate drain according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates a condensate drain pan configured to contain a portion of a coil (not shown), the condensate drain pan generally referenced at 10. The condensate drain pan 10 includes a drain pan panel 12, including a panel interior side 16 and a panel exterior side 18 (shown in FIG. 3), a front wall 20, a rear wall 22, and opposing side walls 24 and 26. The front wall 20, rear wall 22, and opposing side walls 24 and 26 extend from the drain pan panel 12 to form a receptacle being operable to collect condensate. It will be appreciated that the condensate drain pan 10 may be constructed of any durable material to collect condensate; for example, molded plastic to name one non-limiting example.

Figure 2:
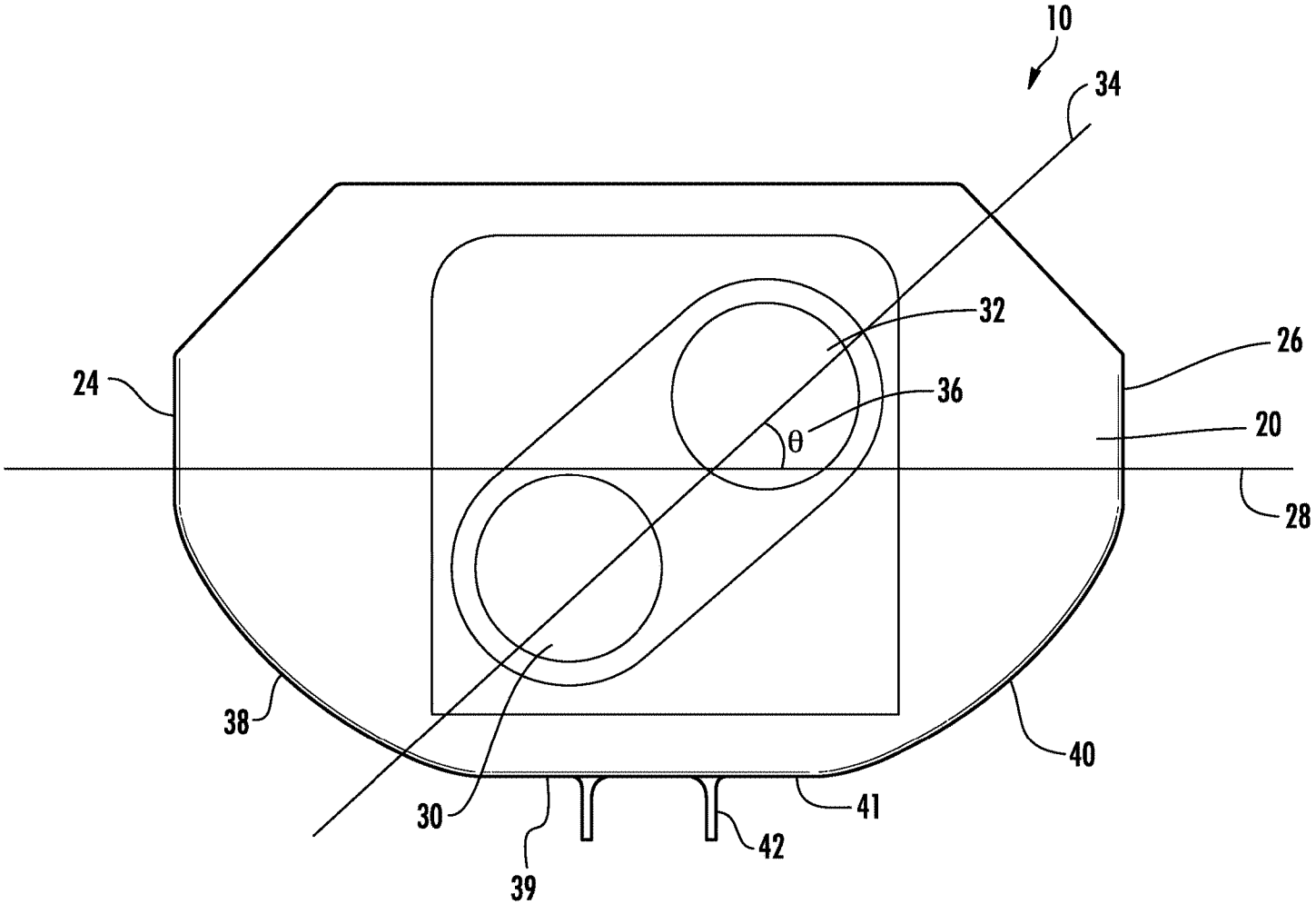
FIG. 2 is a front view of an upflow condensate drain according to at least one embodiment of the present disclosure.

FIG. 2 illustrates a front view of the condensate drain pan 10 according to at least one embodiment. In at least one embodiment, the front wall 20 includes a front wall longitudinal axis 28, a first aperture 30 and a second aperture 32. The first aperture 30 and the second aperture 32 are configured to drain condensate from the panel interior side 16. The first aperture 30 and the second aperture 32 include an aperture axis 34 that forms an angle 36 less than 90 degrees with the front wall longitudinal axis 28. The first aperture 30 may be configured to function as a primary drain of condensate, and the second aperture 32 may be configured to function as an overflow drain of condensate. In one embodiment, at least a portion of the opposing side walls 24 and 26 include a respective curvature 38 and 40 biased towards the drain pan panel 12. In one embodiment the curvatures 38 and 40 may be adjacent to the drain pan panel 12. In one embodiment, as the opposing side walls 24 and 26 extend longitudinally from the front wall 20 to the rear wall 22, the respective curvatures 38 and 40 are gradually reduced to form respective substantially straight sections 39 and 41 to aid in funneling condensation towards the first aperture 30 and the second aperture 32.

Figure 3:
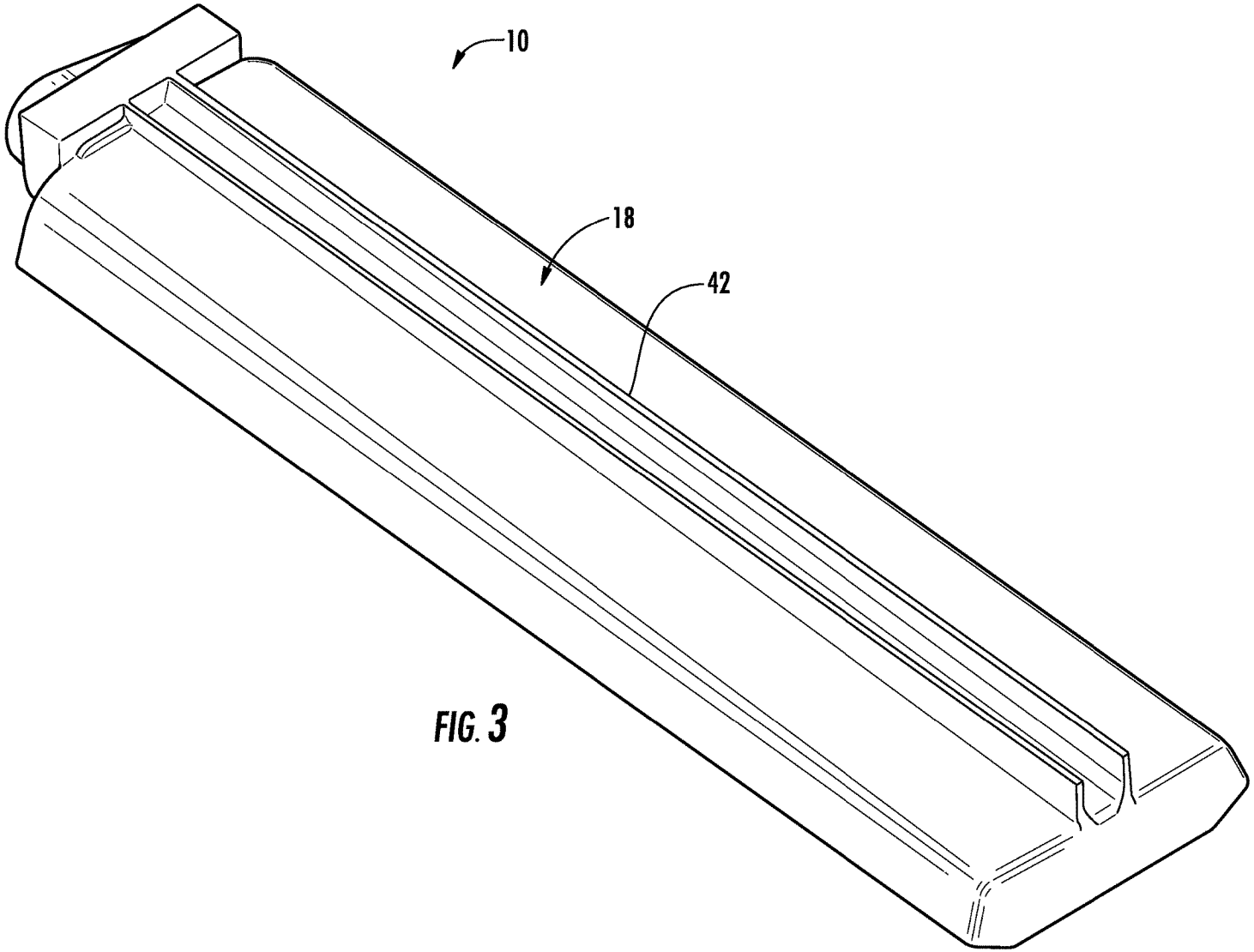
FIG. 3 is a bottom view of an upflow condensate drain according to at least one embodiment of the present disclosure.

FIG. 3 illustrates a bottom view of the condensate pan 10 according to at least one embodiment. In at least one embodiment, a channel member 42 may be formed on the panel exterior side 18. In at least one embodiment, the channel member 42 may be longitudinally formed on the panel exterior side 18. In at least one embodiment, the channel member 42 may be substantially centered on a longitudinal axis of the panel exterior side 18. The channel member 42 may be configured for engaging a mounting bracket to install the condensate drain pan 10 within a fan coil assembly, later explained herein.

Figure 4:
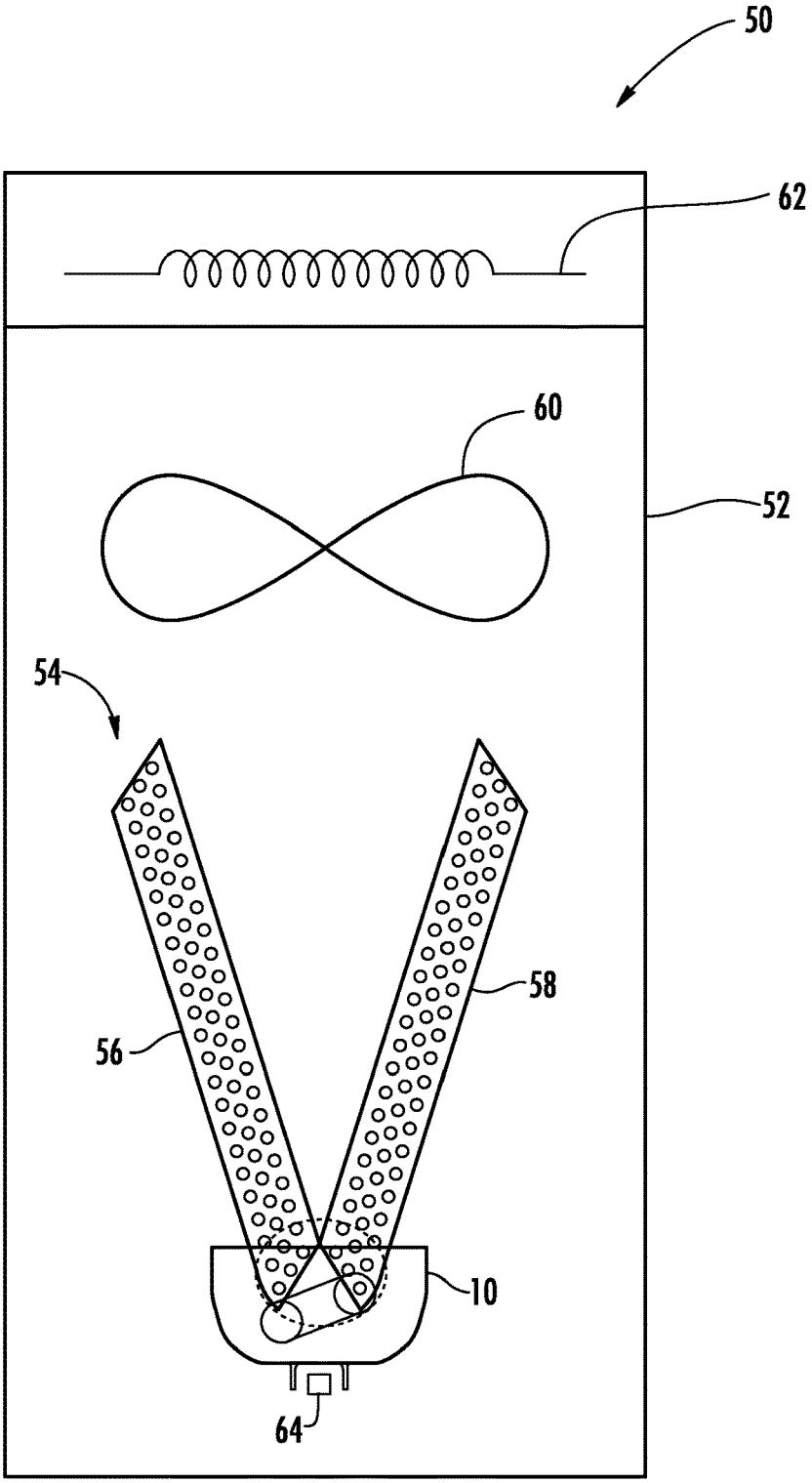
FIG. 4 is a front view of a fan coil assembly according to at least one embodiment of the present disclosure.

FIG. 4 illustrates a front view of a fan coil assembly, generally referenced at 50. The fan coil assembly 50 includes a casing 52, and a coil 54, including a first coil slab 56 and a second coil slab 58, disposed within the casing 52. The coil 54 may be configured to allow a liquid to flow therethrough when responding to a demand for conditioning an interior space. The coil 54 may be composed of copper or aluminum, and arranged in a tube and fin configuration, to name just a few non-limiting examples. It will be appreciated that the coil 54 may include any suitable number of rows of tubes, for example, two or three to name two non-limiting examples. The fan coil assembly 50 includes the condensate drain pan 10 positioned to receive at least a portion of condensate that may drip from the coil 54. In one embodiment, the fan coil assembly 50 further includes a fan 60, disposed within the casing 52, configured to circulate air through the fan coil assembly 50. Fan 60 may be a brushless direct-current powered axial fan, to name just one non-limiting example. In one embodiment, the fan coil assembly 50 further includes an auxiliary heating assembly 62 affixed to the casing 52. It will also be appreciated that the auxiliary heating assembly 62 may be disposed within the casing 52. The auxiliary heating assembly 62 may be configured to provide supplemental heat to an interior space. For example, the auxiliary heating assembly 62 may be a nickel chromium conductive wire or a secondary heating coil configured to allow heater water to flow therethrough to name a couple of non-limiting examples.

In at least one embodiment, the fan coil assembly 50 includes a condensate pan mounting bracket 64 disposed within the casing 52. In at least one embodiment, the condensate pan mounting bracket 64 may be disposed below the fan 60. In at least one embodiment, the condensate pan mounting bracket 64 may be substantially horizontally centered in the casing 52. In at least one embodiment, the channel member 42 may engage the condensate pan mounting bracket 64 to enable installation of the coil 54 within the fan coil assembly 50. It will be appreciated that by placing the condensate pan mounting bracket 64 substantially horizontally centered in the casing 52, the coil 54 may be easily inserted and removed from the casing 52 for maintenance and service. It will also be appreciated that by placing the condensate pan mounting bracket 64 substantially horizontally centered in the casing 52, airflow produced by fan 60 may be evenly distributed across the first and second coil slabs 56 and 58.

Figure 5:
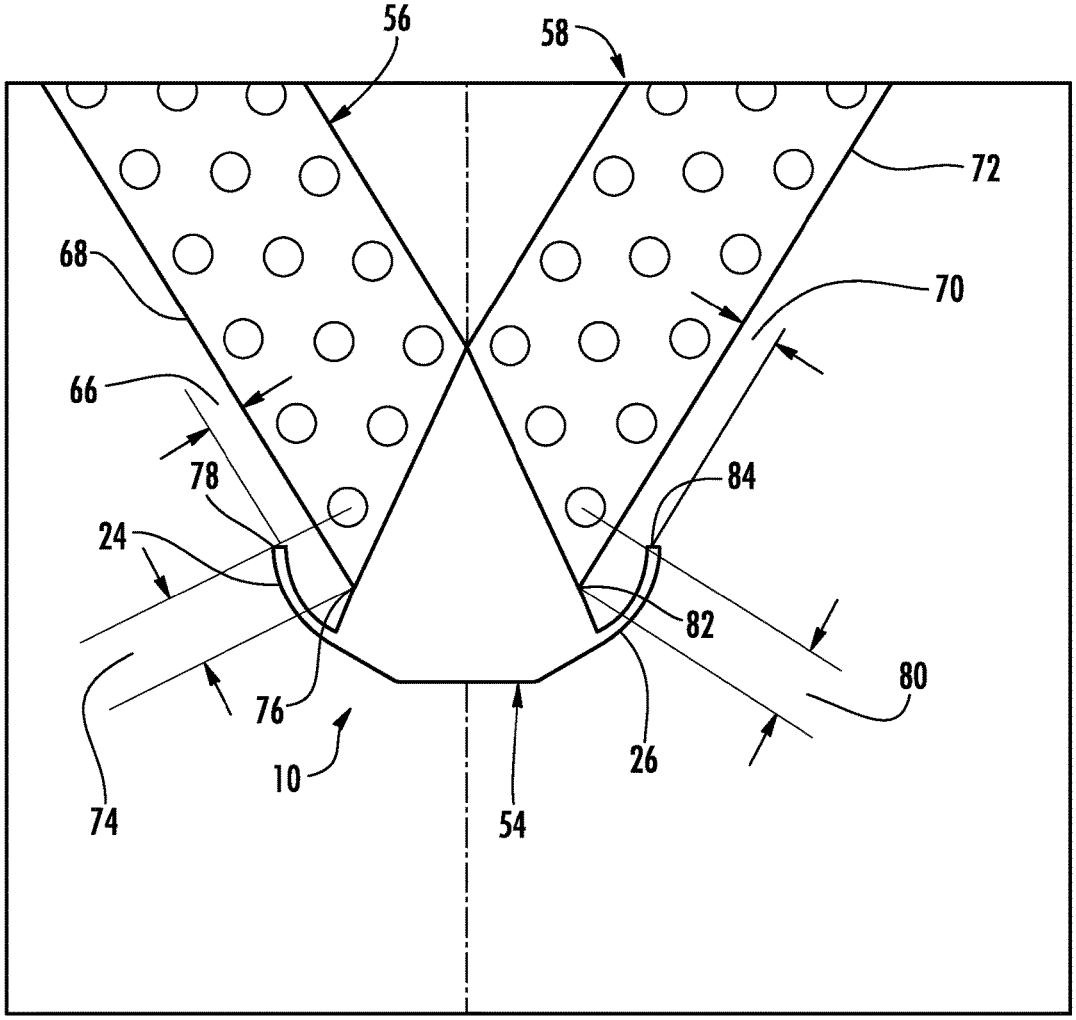
FIG. 5 is a cross-sectional view of the condensate drain pan positioned to receive at least a portion of condensate that may drip from a coil according to at least one embodiment of the present disclosure.

FIG. 5 illustrates a cross-sectional view along line A-A of FIG. 1 of the condensate drain pan 10 positioned to receive at least a portion of condensate that may drip from the coil 54. In at least one embodiment, a first space 66 may be created between an edge 68 of the first coil slab 56 and a top edge 78 of the opposing wall 24, and a second space 70 may be created between an edge 72 of the second coil slab 58 and a top edge 84 of the opposing wall 26. In one embodiment, the first space 66 and the second space 70 include a first dimension less than or equal to approximately 0.375 inch. For example, to minimize the size of the condensate drain pan 10, provide adequate space for condensate drainage, and to optimize airflow across the first coil slab 56 and second coil slab 58, the top edges 78 and 84 of the opposing walls 24 and 26 respectively, may extend no farther than 0.375 inch from the edges 68 and 72 of the first coil slab 56 and the second coil slab 58, respectively. It will be appreciated that the first dimension may be greater than 0.375 inch in other embodiments.

In one embodiment, a third space 74 may be created between an end 76 of the first coil slab 56 and the top edge 78 of the opposing wall 24, and a fourth space 80 may be created between an end 82 of the second coil slab 58 and the top edge 84 of the opposing wall 26. In one embodiment, the third space 74 and the fourth space 80 include a second dimension less than or equal to approximately 0.750 inch. For example, to maximize the amount of airflow exposure to the coil 54, it may be desired for the opposing walls 24 and 26 of the condensate drain pan 10 to cover no more than 0.750 inch from the bottom ends 76 and 82 of the coil 54.

It will be appreciated that the second dimension may be greater than 0.750 inches in other embodiments.

Figure 6:
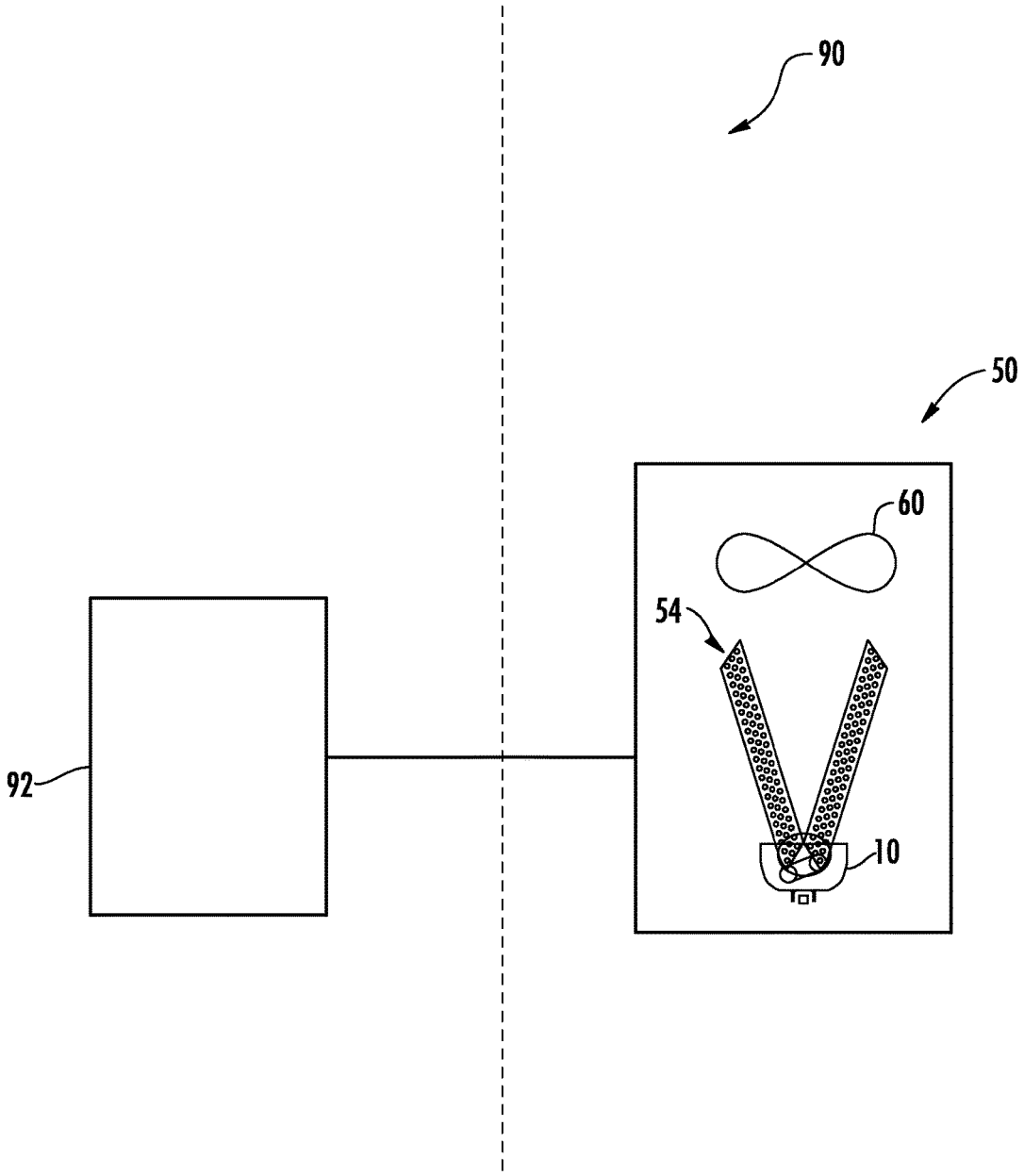
FIG. 6 is a schematic component diagram of an HVAC system according to at least one embodiment of the present disclosure.

FIG. 6 illustrates an embodiment of a heating, ventilation, and air conditioning ("HVAC") system, generally indicated at 90. The HVAC system 90 includes a fan coil assembly 50 operably coupled to a heat pump 92, wherein the fan coil assembly 50 includes a condensate drain pan 10 positioned to receive at least a portion of condensate that may drip from a coil 54. The HVAC system 90 may be configured to provide heating and cooling within an interior space.

It will be appreciated that the condensate drain pan 10 includes a channel member 42 formed on the a panel exterior side 18 to enable easier insertion and removal of the coil 54 from the fan coil assembly 50 for maintenance and service.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A fan coil assembly comprising: a casing;

a coil disposed within the casing, wherein the coil comprises a first coil slab and a second coil slab, and wherein the first coil slab and the second coil slab are configured to form an apex;

a mounting bracket;

a condensate drain pan positioned to receive at least a portion of condensate that may drip from the coil, wherein the condensate drain pan comprises:

a drain pan surface having a straight section spaced from the apex of the coil;

a front wall, including a front wall longitudinal axis;

a panel exterior side;

a channel member longitudinally formed on the panel exterior side, wherein the channel member is substantially centered on a longitudinal axis of the panel exterior side, wherein the channel member is engaged to the mounting bracket;

a rear wall; and opposing side walls having a curvature adjacent to the straight section of the drain pan surface;

wherein the front wall, the rear wall, and the opposing side walls extend from the drain pan surface;

wherein the front wall includes a first aperture and a second aperture substantially centered in the front wall;

wherein the first aperture and the second aperture include an aperture axis; and wherein the aperture axis forms an angle less than 90 degrees with the front wall longitudinal axis;

wherein a first space is created between an edge of the first coil slab and a top edge of one of the opposing side walls, and a second space is created between an edge of the second coil slab and a top edge of the other of the opposing side walls; and wherein the first space and the second space comprise a first dimension equal to 0.375 inch.

2. The fan coil assembly of claim 1, further comprising a fan disposed in the casing.

3. The fan coil assembly of claim 2, further comprising an auxiliary heating assembly affixed to the casing.

4. The fan coil assembly of claim 1, wherein a third space is created between an end of the first coil slab and the top edge of the one of the opposing side walls, and a fourth space is created between an end of the second coil slab and the top edge of the other of the opposing side walls.

5. The fan coil assembly of claim 4, wherein the third space and the fourth space comprise a second dimension equal to 0.750 inch.

6. An HVAC system comprising:

a fan coil assembly operably coupled to a heat pump, wherein the fan coil assembly comprises:

a coil, wherein the coil comprises a first coil slab and a second coil slab, and wherein the first coil slab and the second coil slab are configured to form an apex, and a fan disposed in a casing;

a mounting bracket;

a condensate drain pan positioned to receive at least a portion of condensate from the coil, wherein the condensate drain pan comprises:

a drain pan surface having a straight section spaced from the apex of the coil; a front wall, including a front wall longitudinal axis;

a panel exterior side;

a channel member longitudinally formed on the panel exterior side, wherein the channel member is substantially centered on a longitudinal axis of the panel exterior side, wherein the channel member is engaged to the mounting bracket;

a rear wall; and opposing side walls having a curvature adjacent to the straight section of the drain pan surface;

wherein the front wall, the rear wall, and the opposing side walls extend from the drain pan surface;

wherein the front wall includes a first aperture and a second aperture substantially centered in the front wall;

wherein the first aperture and the second aperture include an aperture axis; and wherein the aperture axis forms an angle less than 90 degrees with the front wall longitudinal axis;

wherein a first space is created between an edge of the first coil slab and a top edge of one of the opposing side walls, and a second space is created between an edge of the second coil slab and a top edge of the other of the opposing side walls; and wherein the first space and the second space comprise a first dimension equal to 0.375 inch.

7. The HVAC system of claim 6, wherein a third space is created between an end of the first coil slab and the top edge of the one of the opposing side walls, and a fourth space is created between an end of the second coil slab and the top edge of the other of the opposing side walls.

8. The HVAC system of claim 7, wherein the third space and the fourth space comprise a second dimension equal to 0.750 inch.

* * * * *